US005528986A

United States Patent [19]

Andersson et al.

[11] Patent Number: 5,528,986

[45] Date of Patent: Jun. 25, 1996

[54] ROTARY PRINTING CASSETTE UNIT SUSPENDED FROM FRAME

[75] Inventors: Ingvar Andersson, Löddeköpinge; Bengt Hersenius, Genarp, both of Sweden

[73] Assignee: Tetra Laval Holdings & Finance SA, Sweden

[21] Appl. No.: 385,037

[22] Filed: Feb. 7, 1995

[30] Foreign Application Priority Data

Feb. 9, 1994 [SE] Sweden ..... 9400423

[51] Int. Cl.[6] ..... B41F 5/04

[52] U.S. Cl. ..... 101/219; 101/152; 101/174; 101/479; 101/DIG. 35

[58] Field of Search ..... 101/152, 174, 101/175, 176, 178, 179, 180, 181, 183, 212, 213, 216, 219, 221, 479, 480, DIG. 38, 247

[56] References Cited

U.S. PATENT DOCUMENTS

| | | | |
|---|---|---|---|
| 2,460,504 | 2/1949 | Huebner | 101/216 |
| 3,766,855 | 10/1973 | Hardt | 61/219 |
| 4,766,809 | 8/1988 | Giori et al. | 101/177 |
| 4,860,650 | 8/1989 | Houser | 101/181 |
| 4,901,641 | 2/1990 | Steiner | 101/152 |
| 5,060,569 | 10/1991 | Gladow | 101/DIG. 35 |
| 5,347,926 | 9/1994 | Fantoni et al. | 101/219 |

*Primary Examiner*—Eugene H. Eickholt
*Attorney, Agent, or Firm*—James Ray & Associates

[57] ABSTRACT

The plural cylinders comprising a printing unit in a rotary printing press, are mounted for synchronous rotation within a single frame structure, aligned under the impression cylinder, such that the frame structure including the cylinders is removably securable to the printing press as a cassette unit. Each cylinder is rotatably journalled within a bearing housing, which is displaceable on a vertical bearing rail. A hydraulic cylinder is disposed under the lowermost bearing housing for lifting and lowering the cylinders, to selectively raise them into engagement or lower them out of engagement.

13 Claims, 10 Drawing Sheets

ROTARY PRINTING CASSETTE UNIT SUSPENDED FROM FRAME

CROSS-REFERENCE TO RELATED APPLICATIONS

The invention taught in this patent application is closely related to the invention taught in the co-pending patent application for: A ROTARY PRINTING PRESS, filed Feb. 7, 1995, Ser. No. 08/385,103. This referenced patent application is being filed concurrently herewith and is assigned to the assignee of this invention. Additionally, the teaching of this patent application is incorporated herein by reference thereto.

TECHNICAL FIELD

The present invention relates to a printing unit for a rotary printing press, in which a web to be printed is arranged to be conducted via an impression cylinder, the different cylinders of the printing unit being arranged in a vertical row.

BACKGROUND OF THE INVENTION

In conventional rotary printing presses, the printing units are normally arranged in the same framework arrangement as the other parts of the printing press, and the framework is placed on the floor. Such construction can be compact but is at the same time difficult to work with.

THE INVENTION

A considerably more useful construction with great advantages in terms of both design and handling is, according to this invention, attained in that the different cylinders of the printing unit are rotatably arranged under the impression cylinder in a separate frame structure of the printing unit, which thereby forms a cassette.

A printing unit built in this way as a cassette can be suspended from a beam structure, which contains the other elements of the printing press, including the impression cylinder.

Special advantages are attained in that each end of each cylinder is rotatably journalled in a bearing housing, which are displaceable along a vertical bearing rail because in this way the cylinders can easily be brought apart from each other for service and maintenance.

A hydraulic cylinder may preferably be arranged in the frame structure under the lowermost bearing housing in a stack of bearing housings for lifting the housings into contact with each other or to lower them from such contact.

As neighboring bearing housings are in contact with each other in their working position, the same mutual position for the cylinders are obtained when the cylinders have been brought apart and are again brought together.

In order to attain a so called "kiss" or "touch" between neighboring cylinders, a wedge arrangement can be provided between two neighboring bearing housings, the wedge arrangement consisting of two opposite wedges, of which one is fixed and the other is displaceable in its longitudinal direction, so that the distance between the bearing housings and thus the cylinders can be finally adjusted.

If the cylinders are lowered with no other adjustments being made, they will remain in contact with each other but jointly displaced to a lower position. It would be advantageous if the cylinders were instead brought apart, so that a spacing is obtained between all the abutting cylinders.

According to this invention, the above proposed advantage is attained in that all the bearing housings in a stack are displaceable along a spacing rod, which is provided with cams and is rotatable by means of a rotating mechanism between a position in which the bearing housings are freely movable along the spacing rod in relation to the cams and a position in which the cams constitute stop means for the bearing housings in their movements downwards along the spacing rod. In this way service can be made on each individual cylinder.

If desired, cylinders may be removed from the printing unit by providing each bearing housing with a clamp, which may be pivoted downward from a vertical closed position to a horizontal open position, in which the cylinders are free to be removed from the bearing housing. In order to prevent a cylinder from unintentionally rolling from the clamp in its horizontal position, the clamp may be provided with an oblique edge at its outer end.

When the cylinders are again brought together, it is of utmost importance that they resume their proper positions in relation to each other and that the gears are in proper position for engagement. Such an alignment and proper gear engagement can be obtained by means of a vertical ruler, which is displaceably attached to the frame structure and is intended for aligning cooperation with bevelled surfaces on the stub axles of the cylinders.

BRIEF DESCRIPTION OF THE DRAWINGS

The invention will be further described below with reference to the attached drawings, in which.

DETAILED DESCRIPTION OF PREFERRED EMBODIMENTS

Figure 1:
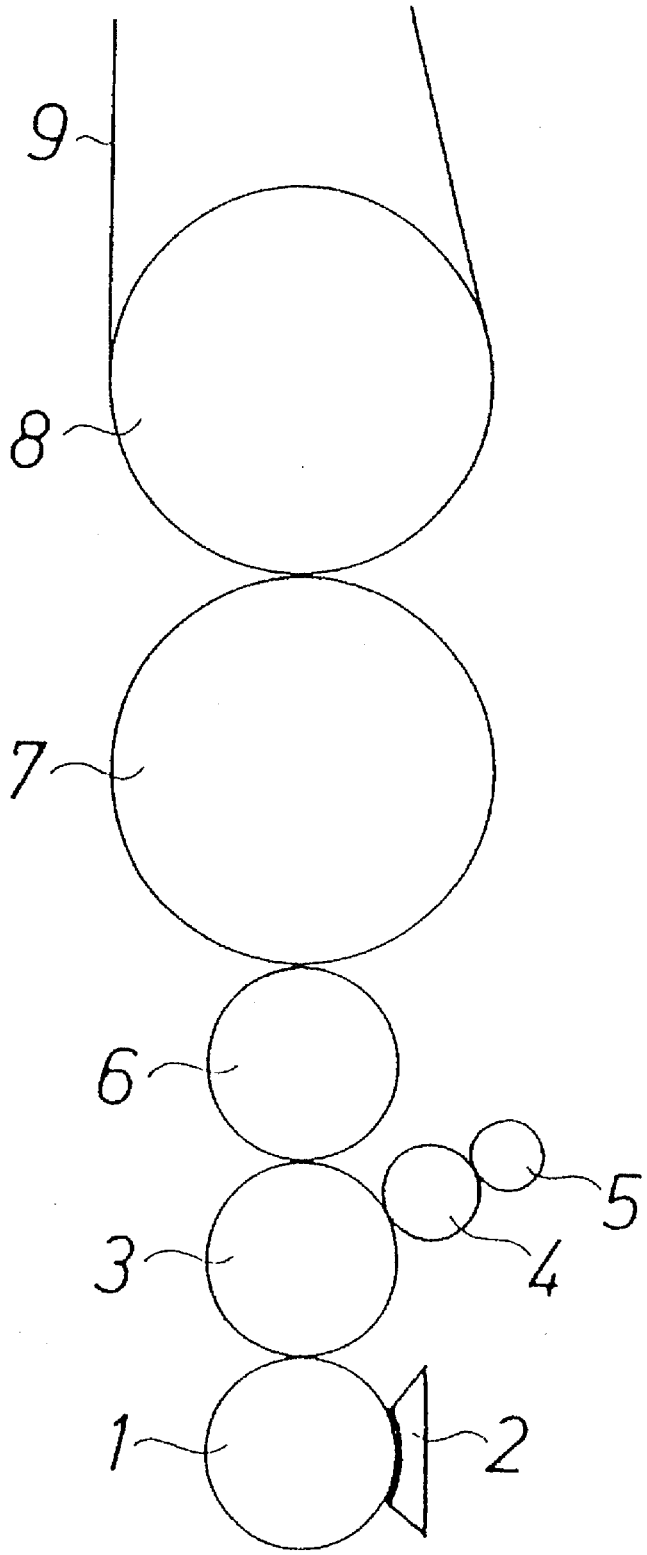
FIG. 1 is a diagrammatic side view of a printing unit according to the invention.

A printing unit for a rotary printing press, schematically shown in FIG. 1, has a number of cylinders described below, which are driven synchronously by means not shown in FIG. 1, for example gearwheels (illustrated in FIG. 3). In the configuration illustrated in FIG. 1, the printing unit in a lowermost position has a screen cylinder 1 (often called an anilox cylinder), which upon rotation picks up printing ink from a doctor chamber 2. The printing ink, which preferably has a very high viscosity, is deposited on the screen cylinder 1, which is provided with a very large number of small depressions for pickup of the printing ink on its entire peripheral surface.

From the screen cylinder 1, the ink is transferred to a form cylinder 3, which bears against the screen cylinder 1 and rotates with the same speed and whose surface is somewhat elastic by virtue of being made of a ground rubber material. In order to accomplish a distribution of the ink on the form cylinder 3 which is as even as possible, an oscillating cylinder 4 (a polished steel cylinder) is in rotational engagement with the form cylinder 3, while a rubber cylinder 5, in turn, is in rotational engagement with the oscillating cylinder 4. In the presently preferred embodiment a fully satisfactory distribution of the ink on the form cylinder 3 is obtained by means of the two above described cylinders 4 and 5, but a greater number of ink distributing cylinders may of course be arranged in the vicinity of the form cylinder 3.

The next cylinder in the printing unit, of the present invention, is a plate cylinder 6, on the periphery of which a printing plate is disposed. At least a part of the periphery of the plate cylinder 6 is made of a magnetic metal material, while the thin and pliable printing plate has a metal base adhering to the periphery of the plate cylinder 6. A plastic layer is provided over the metal base of the printing plate, in which the desired printing pattern is worked out. Other ways of attaching the printing plate onto the plate cylinder 6 are possible, such as by mechanical and/or vacuum based techniques. The plate cylinder 6 bears against the form cylinder 3 and has the same peripheral speed. The screen cylinder 1, the form cylinder 3 and the plate cylinder 6 preferably have the same diameter.

From the plate cylinder 6, the print is transferred to a rubber blanket cylinder 7 (i.e. a rubber blanket covered steel cylinder), which is in contact therewith and has the same peripheral speed. Since the rubber blanket cylinder 7 preferably has twice the diameter as the plate cylinder 6 and thus twice the periphery, the rubber blanket cylinder is rolled two full impressions from the plate cylinder 6 at each revolution. The rubber blanket cylinder 7 can alternatively have three or more times as large a diameter as the plate cylinder 6.

Finally, engaging the rubber blanket cylinder 7 is an impression cylinder 8, preferably with the same diameter as the former cylinder. A web 9 to be printed is rolled and pressed between these two cylinders 7 and 8. This web can be made of a paper material or any other suitable material for receiving print.

FIG. 1 is a schematic illustration of a printing unit. For purposes of simplifying the drawing, no journals, drives or the like are shown. Further guidance with regard to such elements can be obtained from FIGS. 2 and 3 together with the description thereof.

By means of a printing unit as described above it is possible to obtain a printing process which can be said to be an intermediary between flexographic printing and offset printing.

With flexographic printing, which is most suitable for the printing of a single colored, large area, use is made (apart from the impression cylinder) of a block cylinder engaging the web and a screen cylinder cooperating with the block cylinder for receiving the ink.

With offset printing, on the other hand, the process is more complicated with a greater number of cylinders and with printing ink and fountain solution on the non-printing portions of the plate. With the new printing process it is possible to obtain a printing quality which is very close to that which otherwise can only be obtained with offset printing.

Figure 2:
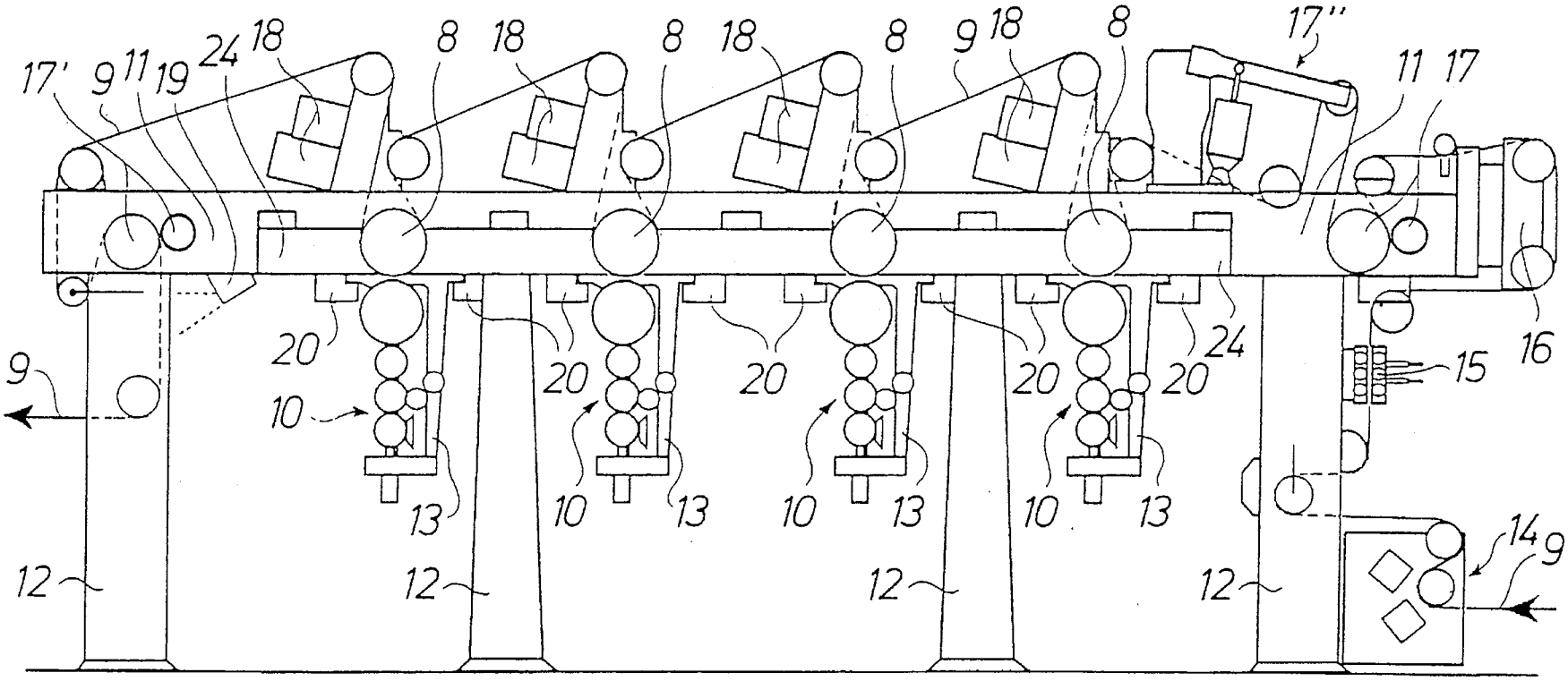
FIG. 2 is a side view of a printing press, including a printing unit according to the invention.

FIG. 2 is a side view of a rotary printing press. This printing press is provided with four printing units of the kind illustrated in FIG. 1 (or alternatively of some other kind). In each such printing unit, the impression cylinder 8 over which the web is conducted, is not herein regarded as included in the printing unit, and have been given the collective reference numeral 10.

The reason why four units has been chosen is of course the traditional one, namely that all printing colors can be obtained by means of the four colors yellow, bluish red (magenta), greenish blue (cyan) and black. In special cases, when a special color ("house color") is used to a large extent for printing, a fifth printing unit can be provided for this color.

A distinctive feature with the printing press according to FIG. 2 is that it is disposed on a strong beam structure 11, from which the printing units 10 are suspended, and on which in principle all other equipment, described below, can be attached. This beam structure 11 can be supported on the floor by means of pillars 12, as shown in FIG. 2, but can, in principle, quite as well be suspended from the ceiling of a printers building. The advantage with this construction is that the floor under the printing press is free for the operators and that the printing units and other equipment is extremely accessible.

Each printing unit 10 is arranged in a frame 13, which is suspended from the beam structure 11. Each such printing unit 10 with its frame 13, which together can be called a cassette, can easily be dismounted and serviced or exchanged with a new cassette.

The web 9 enters the printing press to the right, as seen in FIG. 2, where it is first exposed to surface treatment at a treating unit 14 and thereafter cleaned in a cleaning unit 15. A lateral guiding arrangement 16 is disposed at the end of the beam structure 11 and accomplishes a lateral guiding and alignment of the web 9 by turning the web 9 around an axis parallel with the longitudinal axis of the beam structure 11.

The web tension, which is essential for the function of the printing press and the quality of the print, is controlled by means of entrance nip cylinders 17 and exit nip cylinders 17' and also (if needed) a web tension arrangement 17" can be utilized, which consists of a tilting lever, which is controlled by means of a pneumatic cylinder and has a roller, over which the web 9 is conducted.

After having passed over the impression cylinder 8 in a printing unit, where the web 9 has been provided with printing in the form of an array of high viscosity printing ink, the web 9 passes a drying device 18. Normally, such a drying device 18 consists of UV-lamps, as the printing ink normally used is of the type hardened by means of UV-radiation. Alternatively, hot air drying or other drying techniques can be used.

When the web 9 has passed all printing units 10 in the printing press and has been provided with the desired four color-print, it can pass through an inspection system, for example, past a stroboscope lamp 19, so that an operator can check the printing quality, before the printed web 9 leaves the printing press at the left as seen in FIG. 2.

The impression cylinders 8, over which the web 9 is conducted, are rotatably journalled in the beam structure 11, whereas the cylinders 1, 3–7 of each printing unit 10 are rotatably journalled in the frame 13. Upon an exchange of printing format, i.e. a change of cylinder diameters, or possibly a change of printing ink, the printing unit cassettes 10, 13 can easily be removed from the printing press and be replaced with new cassettes. These new cassettes can be prepared during the previous run. With the inventive printing press, as described above, the time lost at a cassette exchange becomes extremely short. Upon a cassette exchange the web 9 is further not affected, which minimizes the waste when cassettes are changed.

As shown in FIG. 2, the printing unit cassettes 10, 13 can be suspended from brackets 20 on the underside of the beam structure 11 and accordingly, can be pulled out laterally and manipulated, for example, with trolleys.

The construction as described is very operator friendly and leaves the floor principally free. The suspended printing units with the ink storage (the doctor chambers 2) in the lowermost position is such that ink cannot pour over the equipment. As can be seen, the web path between the printing units can be very short and stable.

Figure 3:
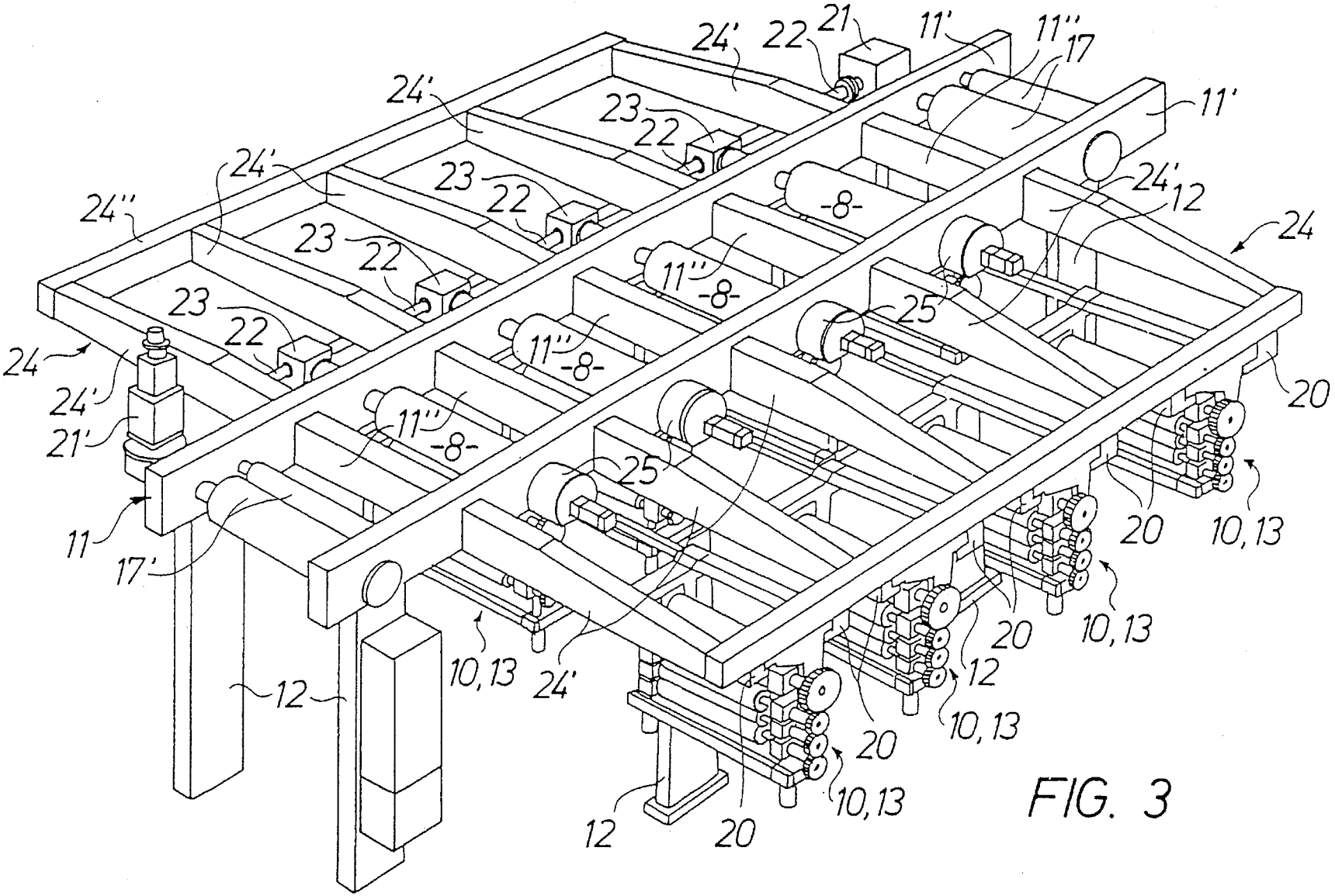
FIG. 3 is a view seen obliquely from above the printing press as shown in FIG. 2 with certain parts eliminated at the top side for the sake of clarity.

In FIG. 3, where the printing press is shown in an oblique top view, the peripheral equipment on the top side of the beam structure 11 has not been shown in order that certain aspects of the design shall appear more clearly. As shown in FIG. 3, the beam structure 11 consists of longitudinal beams 11' and cross beams 11". The beam structure 11 is supported by the pillars 12.

The impression cylinders 8 and the entrance nip cylinders 17 and the exit nip cylinders 17' are rotatably journalled in the longitudinal beams 11' of the beam structure. The impression cylinders 8 and the entrance nip cylinders 17 in the beam structure 11 are arranged to be driven by means of an electric primary motor 21 via longitudinal drive shafts 22 and angle joints 23. The exit nip cylinders 17' are arranged to be driven by means of an electric motor 21'.

A jib arrangement 24 is provided on either side of the beam structure 11 and consists, for example, of cross bars 24', attached to the longitudinal beam 11', and a longitudinal bar member 24". The jib arrangement 24 at one side of the beam structure 11 is also visible in FIG. 2. The jib arrangement 24 can, if required, also be supported by pillars 12, as shown in FIG. 2.

The brackets 20 mentioned above and as shown in FIG. 2, or the roller conveyors used in place thereof, for the printing unit cassettes 10, 13 are arranged at the lower side of the jib arrangement 24. As is apparent from FIG. 3, printing unit cassettes 10, 13 in one set can be pulled out to the right under the jib arrangement 24 for treatment and/or service after a previous print run and preparations for a coming print run, while at the same time, a second set of printing unit cassette 10, 13 can be positioned for printing under the impression cylinders 8. (For the sake of clarity only one printing unit cassette 10, 13 is shown in the printing position with a reference numeral in FIG. 3).

When the printing is completed, the second set of printing unit cassettes 10, 13 can easily be brought out under the jib arrangement 24 to the left as seen in FIG. 3, while the printing unit cassettes 10, 13 under the jib arrangement 24 to the right as seen in FIG. 3, prepared for the coming printing, are brought into position for printing under the impression cylinders 8. An extremely short replacement time between different print runs can therefore be achieved, and accordingly a very high operating efficiency is also realized.

The system can be completed with an external handling system in the form of trolleys or a traverse for handling the printing unit cassettes 10, 13, either individually, or possibly even two or more at a time.

As is clearly illustrated in FIG. 3, the different cylinders in each printing unit cassette 10, 13 are connected to one another by means of a set of gearwheels. When the cassette is brought into its printing position under its impression cylinder 8, the uppermost gearwheel in this gearwheel set will be brought into engagement with a corresponding gearwheel of an output gearbox 25 on the outgoing shaft of the impression cylinder 8.

It should be observed that the beam structure 11 with the printing units 10, 13 arranged thereunder is the core of the construction and that the jib arrangements 24, while presently preferred, is not an essential element of the invention.

The present invention relates to the printing unit, per se, in the printing press, and this printing unit will now be more fully described with reference to FIGS. 4–11. As earlier mentioned, the printing press is provided with four or more suspended printing units, which, in principle, all have the same design, and accordingly only one such printing unit will be described.

Figure 4:
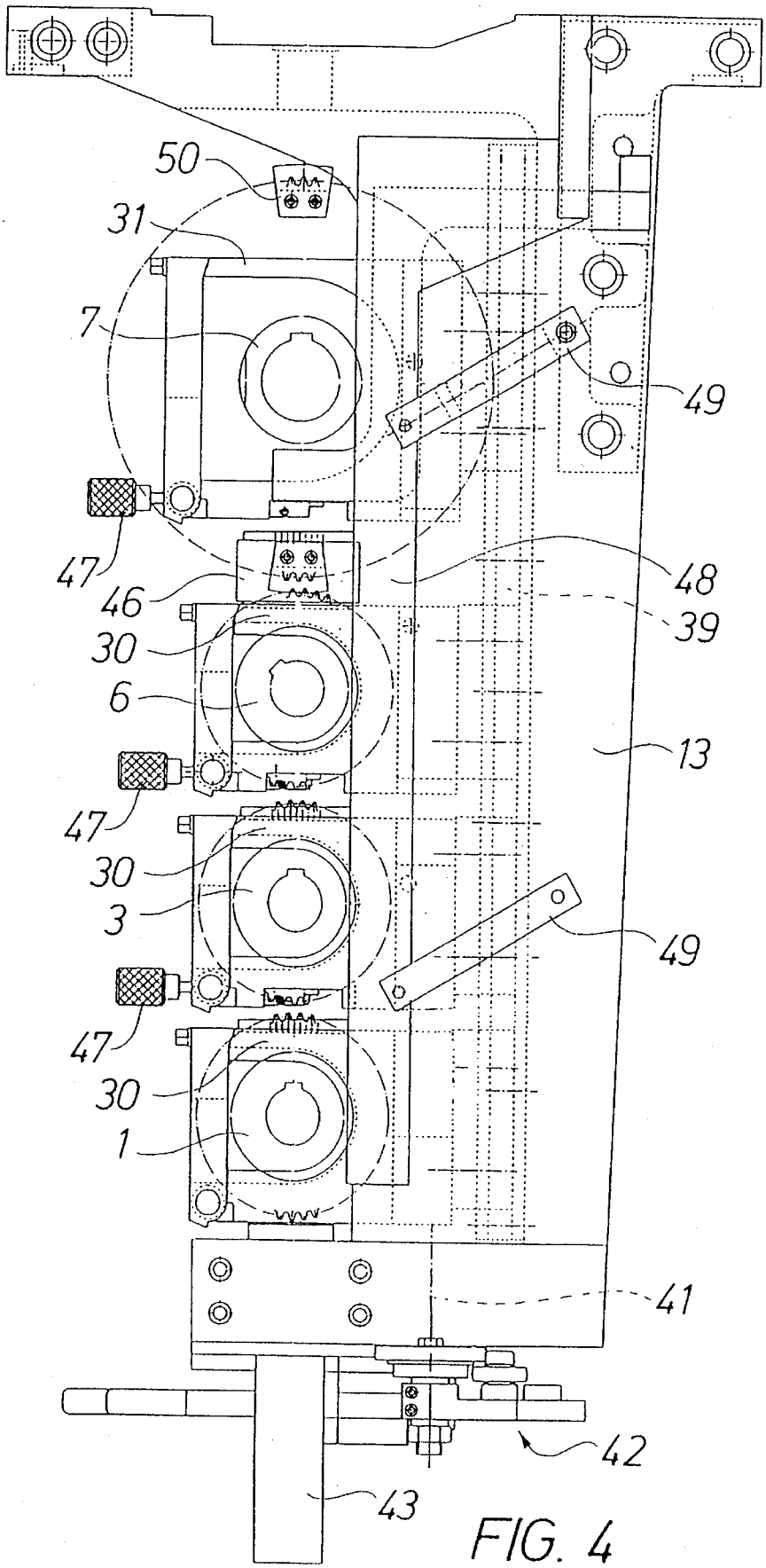
FIG. 4 is a side view of the printing unit shown in FIG. 1.
Figure 5:
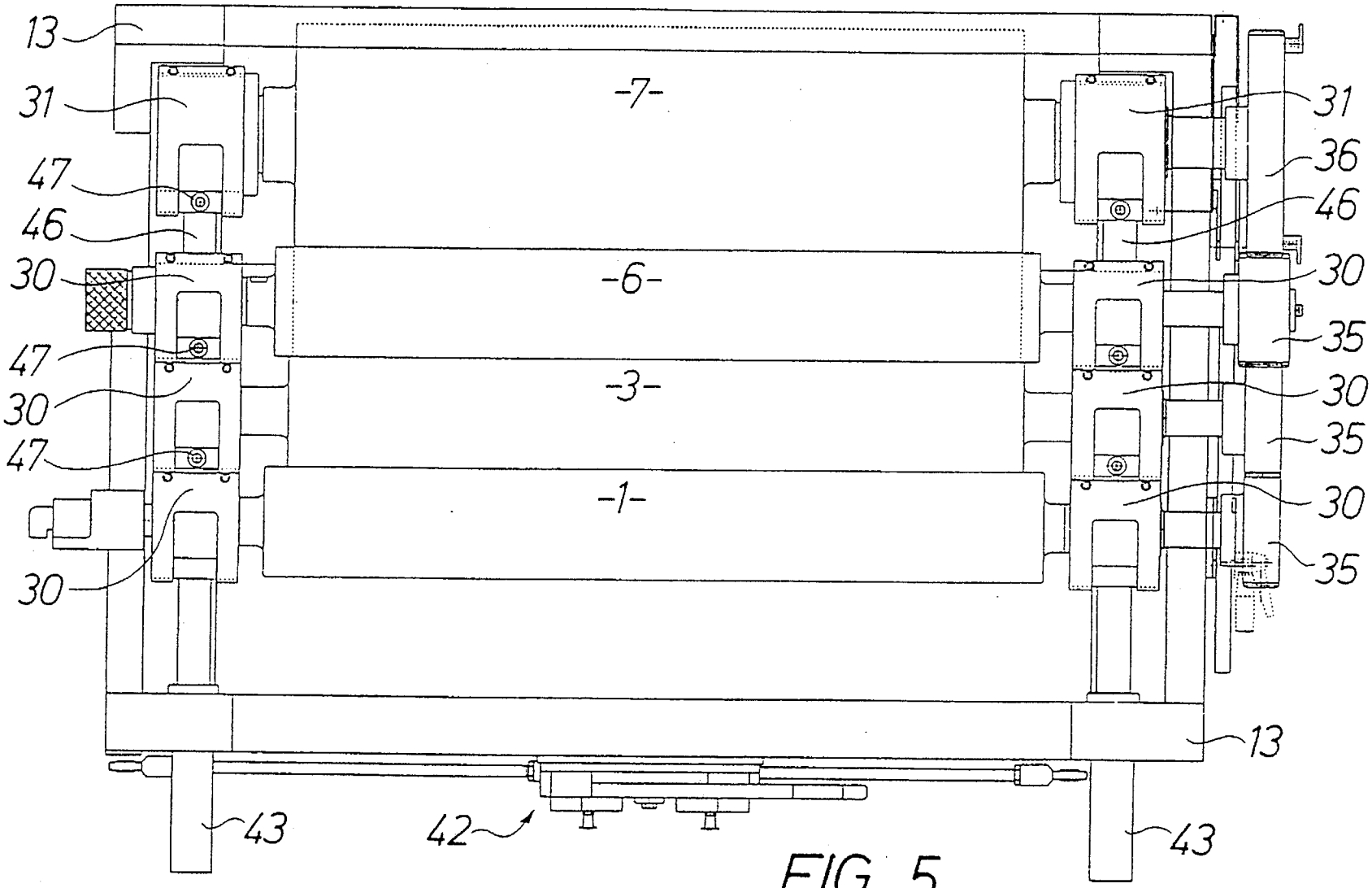
FIG. 5 is a front view of the printing unit (to a smaller scale than FIG. 4)
Figure 6:
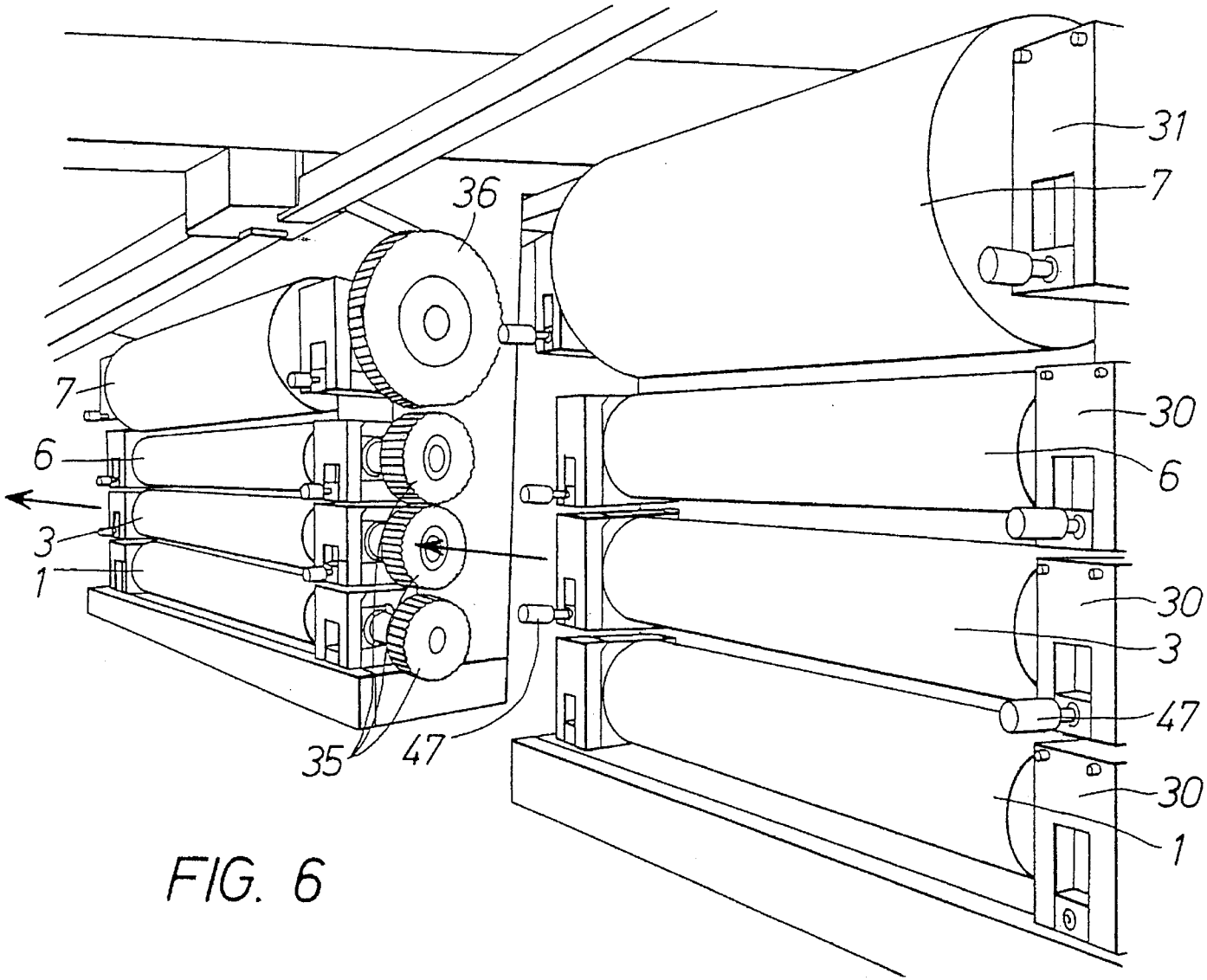
FIG. 6 is a perspective view of two printing units as positioned for use in a printing press.

FIGS. 4 and 5 show the printing unit in a side view and a front view, respectively. In the frame 13 of the printing unit, the screen cylinder 1, the form cylinder 3, the plate cylinder 6 and the rubber blanket cylinder 7 are journalled by means of bearing housings, which for the three first mentioned cylinders are of equal size and have been given the numeral 30, since the rubber blanket cylinder 7 is larger, it has been given the numeral 31.

The design for the bearing housings 30 and 31 are in principle the same, and the description of the bearing housing 30 is also applicable to the bearing housing 31 in relevant parts.

Figure 7:
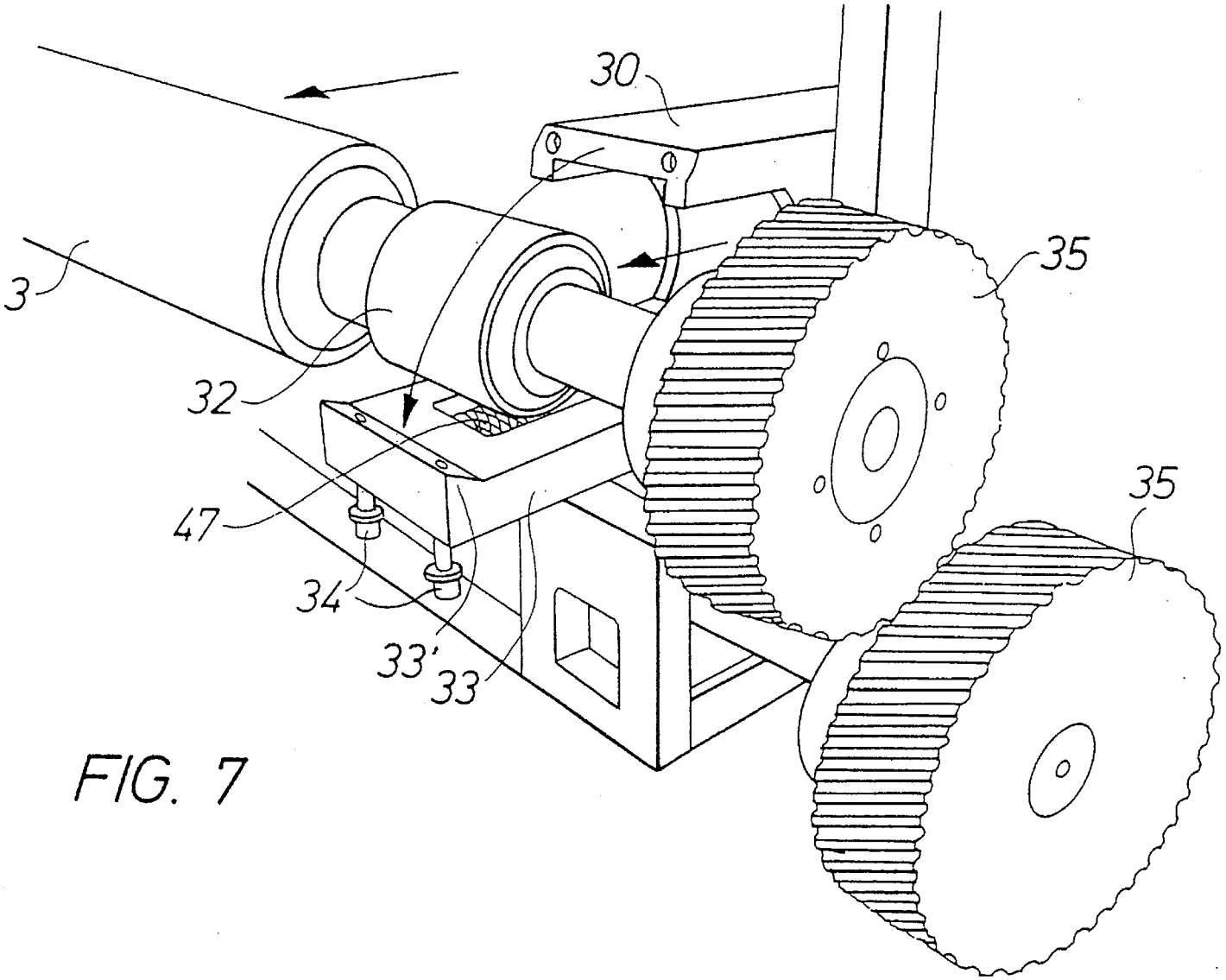
FIG. 7 is a perspective view illustrating how a cylinder is removed from the printing unit according to the invention.

It should appear especially clearly from FIG. 7, that the stub axle for the cylinder, in this case the form cylinder 3, is provided with a permanently mounted roller bearing 32, which is arranged in the bearing housing 30. The bearing housing 30 is provided with a pivotal clamp 33, which can be fixed to the bearing housing 30 by means of bolts 34. In order to prevent the form cylinder 3 from unintentionally rolling from the clamp 33 in the horizontal lowered position, such clamp 33 has an oblique edge 33'.

It should also be readily apparent from FIG. 7 that the gearwheel 35 at the end of each cylinder stub axle is a gearwheel with oblique teeth (even if straight-toothed gearwheels are shown in other figures for the sake of simplicity). The larger gearwheel for the rubber blanket cylinder 7 has the numeral 36. All gearwheels are arranged outside the frame 13. In order to obtain an operation which is as silent as possible, every second wheel may be made of a harder material and the remaining wheels of a softer material.

Figure 8:
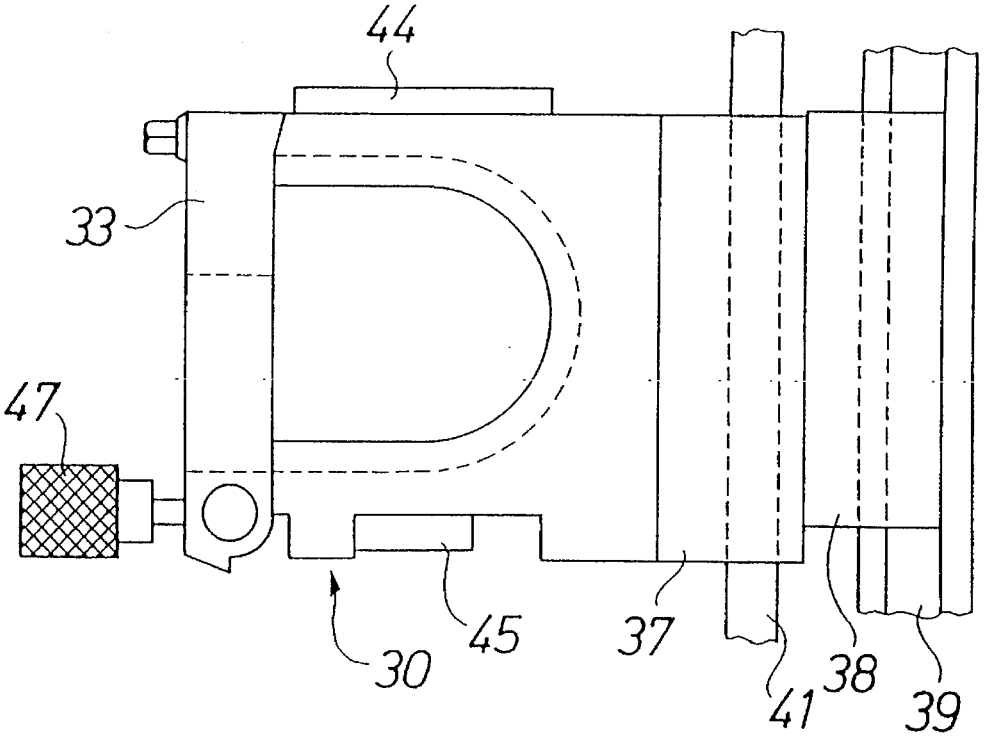
FIGS. 8 and 9 are a side view and a top view, respectively, of a bearing housing with neighboring means for the printing unit according to the invention (shown in a larger scale)
Figure 9:
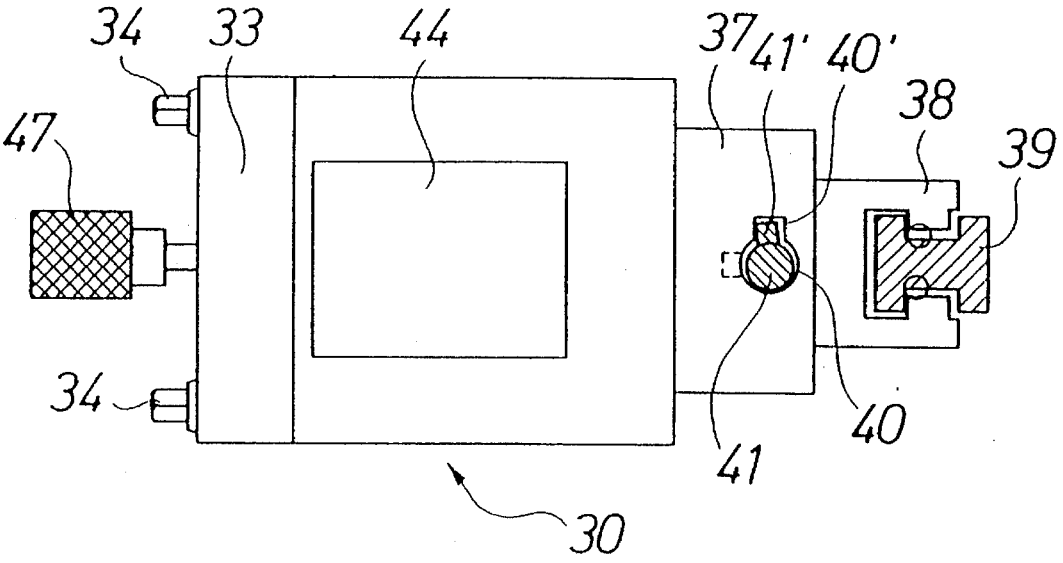
Figure 10:
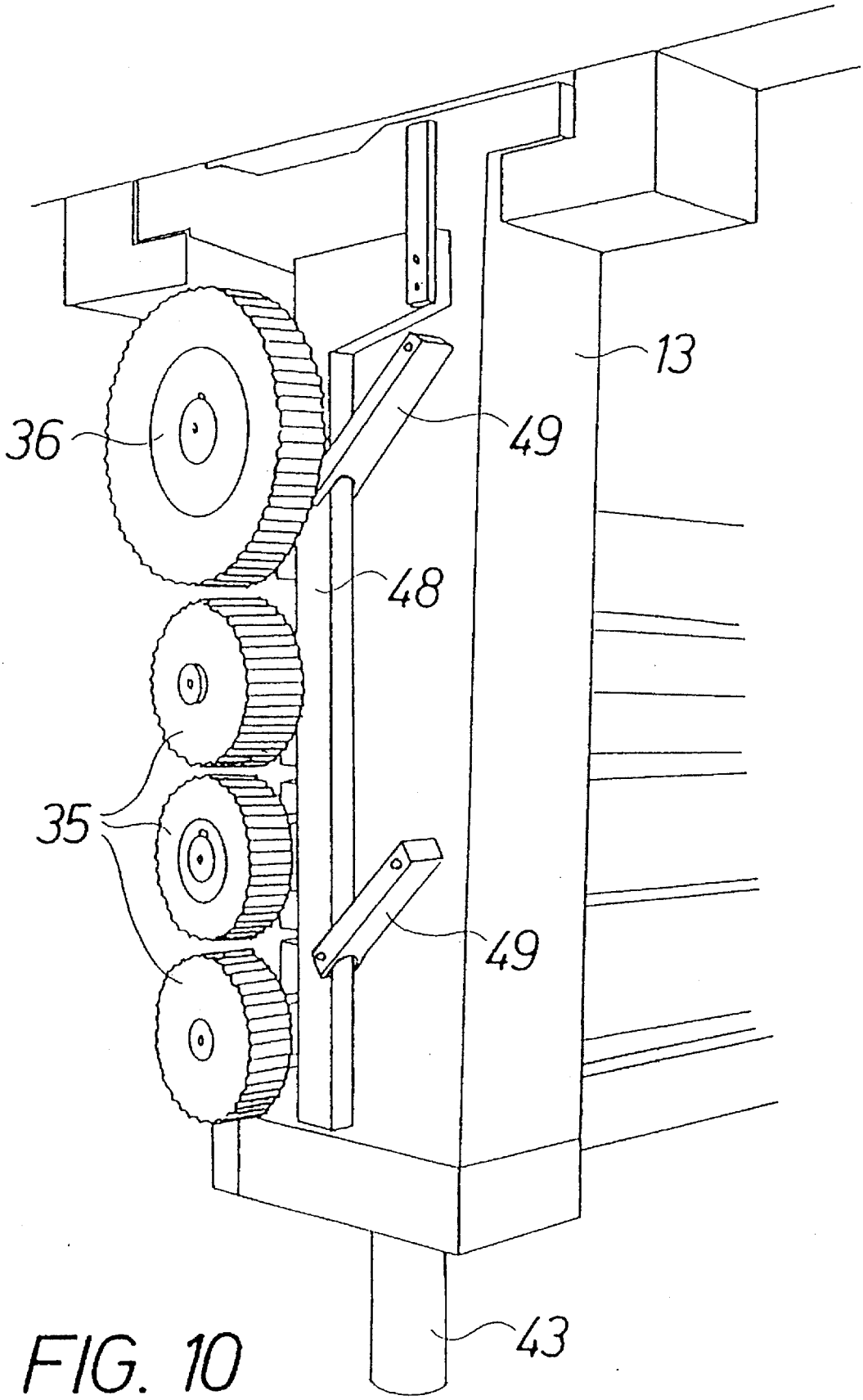
FIGS. 10 and 11 are a perspective view and a schematic side view, respectively, of the printing unit and are intended to illustrate an aligning ruler.
Figure 11:
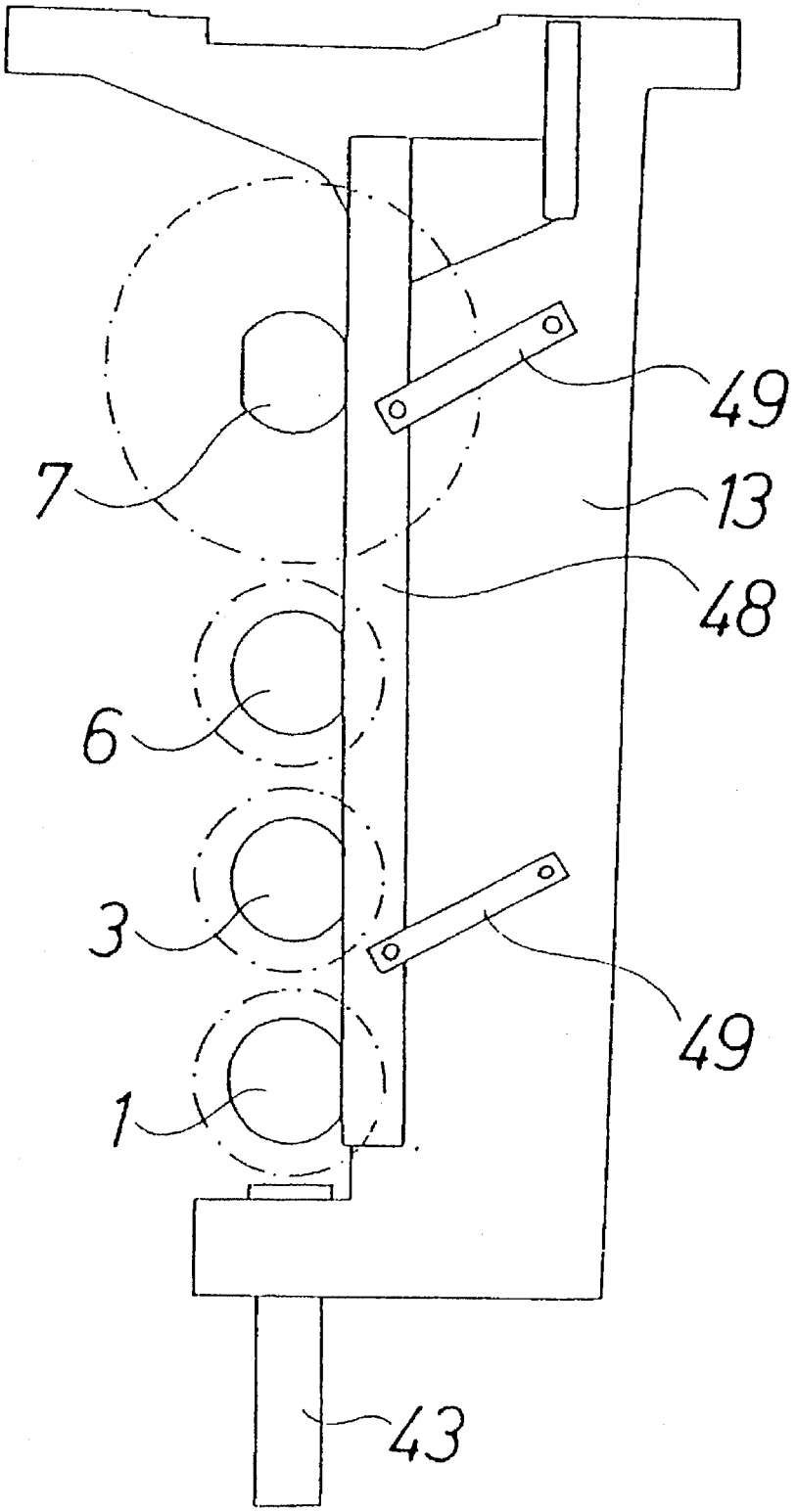

As most clearly illustrated in FIGS. 8 and 9, each bearing housing 30 and 31 is provided with a spacing unit 37 and an axial bearing unit 38 for the mounting and guiding of the bearing housing 30 and 31 in the frame 13 in a way to be more fully described below.

A vertical bearing rail 39 is fixedly arranged at either side of the frame 13 and forms an axial bearing together with the bearing unit 38, which is provided with balls, so that the bearing housings 30 and 31 accordingly become vertically displaceable in an easy manner.

The spacing unit 37 is provided with a vertical bore 40 for a spacing rod 41, which in FIG. 4 only is indicated by means of its center line. The two spacing rods 40, which are rotatably journalled in the frame 13, can be rotated synchronously, for example through 90°, by means of a rotating mechanism 42 disposed at the under side of the printing unit (FIGS. 4 and 5).

Each spacing rod 41 is provided with a number of cams 41' and the bore 40 in each spacing unit 37 has a corresponding channel 40'. In the position illustrated in FIG. 9, the bearing housing 30 can accordingly move freely in relation to the spacing rod 40, whereas the mutual distance of the cams 41' along the spacing rod 40 in relation to the height of the bearing housings 30 and 31 leads to the situation, especially well illustrated in FIG. 4 but also shown in FIGS. 6, 10 and 11, where the bearing housings 30 and 31 "hang" on the cams 41', when the spacing rod 40 has been rotated for example through 90° by means of the rotating mechanism 42 and the bearing housings 30 and 31 have been allowed to descend from their positions against each other.

Under each stack of bearing housings 30 and 31 there is a hydraulic cylinder 43 for raising and lowering such bearing housings 30 and 31 arranged in the frame 13. At lifting the bearing housings 30 and 31 will come into engagement with each other via wedge means described in greater detail hereinafter, and at lowering the above described hanging position is obtained, in which the cylinders 1, 3, 6 and 7 can be released from their bearing housings 30 and 31 and possibly be exchanged and/or serviced.

Wedge means, consisting of a fixed wedge 44 on the upper side of the bearing housing 30 and an adjustable wedge 45 at the under side of the bearing housing situated thereabove, are arranged between two neighboring bearing housings 30 in the stack. Due to the greater diameter of the rubber blanket cylinder 7 a distance element 46 (FIG. 4) is arranged between the bearing housing just below the bearing housing 31 and its fixed wedge 44.

The adjustable wedge 45 can be displaced in the longitudinal direction of the bearing housing, for example, by means of an adjustment screw 47. The bearing housing 30 for the lowermost cylinder 1 has no adjustable wedge 45, and the uppermost bearing housing 31 has no fixed wedge 44.

The wedge angle of the wedge pair 44, 45 is small, for example 1°, for obtaining a rather high degree of accuracy in the adjustment of the contact or distance between the neighboring cylinders; i.e., the so called "kiss" or "touch". The previously adjusted position between neighboring cylinders is regained, when the cylinders 1, 3, 6 and 7 are brought together by means of the hydraulic cylinders 43 (after earlier having been brought apart), but a manual adjustment at each end of each cylinder can of course always be performed.

A corresponding adjustment between the rubber blanket cylinder 7 and the impression cylinder 8 taking account the thickness of the web 9 used can easily be performed by means of a motor-driven wedge.

For the purpose of obtaining correct mutual positions at the bringing together of the cylinders 1, 3, 6 and 7, so that the print will obtain a correct position and engagement of the gears can occur, the following arrangement is used.

One of the stub axles of each cylinder 1, 3, 6 and 7 has a bevel in the vicinity of the gearwheel 35 or 36, and a vertical ruler 48 (FIGS. 10 and 11) can be brought into engagement with all these bevels in connection in the bringing together of the cylinders 1, 3, 6 and 7. The vertical ruler 48 is connected with the frame 13 by means of two links 49 for obtaining a parallel displacement.

Indicating means 50 for indicating a correct gear engagement for the impression cylinder 8 are provided on the rubber blanket cylinder 7, which, as shown, has two bevels on the stub axle, as two diametrically opposed positions are correct for this impression cylinder 8.

The operation at the preparation of the printing unit for printing is as follows: The cylinders 1, 3, 6 and 7 are manually rotated to a roughly correct position, whereupon final alignment occurs by means of the vertical ruler 48. The drive wheel of the impression cylinder 8 is brought to a correct position by means of a servo motor, and the engagement of the gearwheels occurs by means of the lifting cylinders 43.

We claim:

1. A printing unit for a rotary printing press in which a web to be printed is caused to be conveyed via at least one rotating impression cylinder past said printing unit for printing on such web, said printing unit comprising a plurality of cylinders rotatably mounted for synchronous rotation within a single frame structure, and including a plate cylinder adapted to press against said web passing intermediate said impression cylinder and said plate cylinder, said single frame structure comprising a cassette displaceable from such rotary printing press and adapted to be mounted to such printing press in a suspended position hanging from means for attaching said cassette to such printing press without any means for supporting said cassette from underneath so that a floor area under such printing press is devoid of any supporting structure.

2. A printing unit for a rotary printing press in which a web to be printed is caused to be conveyed via at least one rotating impression cylinder past said printing unit for printing on such web, said printing unit comprising a plurality of cylinders rotatably mounted for synchronous rotation within a single frame structure, and including a plate cylinder adapted to press against said web passing intermediate said impression cylinder and said plate cylinder, said single frame structure comprising a cassette displaceable from such rotary printing press and adapted to be mounted to such printing press in a suspended position hanging from means for attaching said cassette to such printing press, said cassette being displaceable from said rotary printing press along a vertical bearing rail.

3. A printing unit for a rotary printing press, according to claim 2, further including a drive means within said frame structure acting on said bearing housings adapted to bring said cylinders into contact with each other and displace said cylinders from contact with each other.

4. A printing unit for a rotary printing press, according to claim 3, in which said drive means comprises a hydraulic cylinder disposed under the bearing housing of a lower-most cylinder of said plurality of cylinders, adapted to selectively lift said cylinders into contact and lower said cylinders from contact.

5. A printing unit for a rotary printing press, according to claim 4, in which said bearing housings are disposed in a generally vertical alignment one over another.

6. A printing unit for a rotary printing press, according to claim 4, in which said bearing housings are displaceable along a spacing rod adapted to keep said bearing housings in proper alignment.

7. A printing unit for a rotary printing press, according to claim 6, in which said spacing rod is provided with a cam for each of said bearing housings, and is adapted for at least partial rotation between a position in which said bearing housing are freely movable along said spacing rod in relation to said cams, and a position in which said cams constitute a stop means to engage and position said bearing housings in their movement along said spacing rod.

8. A printing unit for a rotary printing press, according to claim 7, further including a rotating mechanism for effecting said at least partial rotation.

9. A printing unit for a rotary printing press, according to claim 7, in which each of said bearing housings has an bore through which said spacing rod extends with each of said bores having a channel adapted to pass around an adjacent cam when said spacing rod is positioned to align said cams with said channels.

10. A printing unit for a rotary printing press, according to claim 7, in which at least one of said bearing housings includes a clamp which can be pivoted between a generally vertical, closed position whereby said clamp engages a cylinder associated therewith, and a generally horizontal, open position whereby said cylinder associated therewith is free to be removed from said bearing housing.

11. A printing unit for a rotary printing press, according to claim 10, in which said clamp is provided with a oblique edge adapted to prevent said associated cylinder from unintentionally rolling from said clamp is in its generally horizontal, open position.

12. A printing unit for a rotary printing press, according to claim 11, further including a vertically disposed ruler attached adjacent to said frame structure and adapted for parallel movement relative thereto for purposes of aiding in adjustment of said cylinders.

13. A printing unit for a rotary printing press, according to claim 12, in which each of said cylinders is provided with a stub axle having a bevel, and said ruler can be brought into engagement with said bevels for purposes of properly positioning said cylinders as indicated by said ruler.

* * * * *